US008820110B2

(12) United States Patent
Schenk et al.

(10) Patent No.: US 8,820,110 B2
(45) Date of Patent: Sep. 2, 2014

(54) ICE AND WATER SYSTEM IN REFRIGERATOR WITH STIRRING FAN IN ICE CHAMBER

(75) Inventors: Dennis Schenk, Anderson, SC (US); Xiaoyong Fu, Greer, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 551 days.

(21) Appl. No.: 12/712,818

(22) Filed: Feb. 25, 2010

(65) Prior Publication Data

US 2011/0203305 A1 Aug. 25, 2011

(51) Int. Cl.
*F25D 3/02* (2006.01)
*F25C 5/18* (2006.01)

(52) U.S. Cl.
USPC ..... 62/420; 62/344

(58) Field of Classification Search
USPC ..... 62/420, 425, 344, 459
See application file for complete search history.

(56) References Cited

U.S. PATENT DOCUMENTS

| | | | | |
|---|---|---|---|---|
| 6,082,130 | A * | 7/2000 | Pastryk et al. | 62/344 |
| 6,351,955 | B1 | 3/2002 | Oltman et al. | |
| 6,438,988 | B1 | 8/2002 | Paskey | |
| 6,655,158 | B1 | 12/2003 | Wiseman et al. | |
| 6,955,056 | B1 | 10/2005 | An et al. | |
| 6,964,177 | B2 | 11/2005 | Lee et al. | |
| 7,131,280 | B2 | 11/2006 | Voglewede et al. | |
| 7,185,508 | B2 | 3/2007 | Voglewede et al. | |
| 7,188,479 | B2 | 3/2007 | Anselmino et al. | |
| 7,222,497 | B2 | 5/2007 | An et al. | |
| 2005/0156026 | A1 * | 7/2005 | Ghosh et al. | 235/380 |
| 2006/0137382 | A1 | 6/2006 | Sasaki et al. | |
| 2006/0260344 | A1 | 11/2006 | Martin et al. | |
| 2006/0260350 | A1 * | 11/2006 | Van Meter et al. | 62/407 |
| 2006/0260351 | A1 | 11/2006 | Coulter et al. | |
| 2006/0266059 | A1 * | 11/2006 | Wetekamp et al. | 62/187 |
| 2008/0034779 | A1 | 2/2008 | Lee et al. | |
| 2008/0034780 | A1 | 2/2008 | Lim et al. | |
| 2008/0156000 | A1 | 7/2008 | Shin et al. | |
| 2008/0156026 | A1 * | 7/2008 | Shin et al. | 62/353 |
| 2008/0209937 | A1 * | 9/2008 | Wu et al. | 62/340 |
| 2008/0295539 | A1 * | 12/2008 | An et al. | 62/407 |
| 2009/0205356 | A1 * | 8/2009 | Collins et al. | 62/426 |

FOREIGN PATENT DOCUMENTS

EP 1930671 6/2008

OTHER PUBLICATIONS

Closed-Cycle Air Refrigeration Technology: Economic Case Study, Aug. 2, 2005, pp. 1 and 2.*
International Search Report for PCT/US2011/025603 dated Jun. 8, 2011, 2 pages.

* cited by examiner

*Primary Examiner* — Allana Lewin
*Assistant Examiner* — Dawit Muluneh
(74) *Attorney, Agent, or Firm* — Pearne & Gordon LLP

(57) ABSTRACT

A refrigerator includes a freezer compartment and a fresh food compartment which includes an ice chamber. The ice chamber includes an ice maker which includes a first heat exchanger for producing ice. The ice chamber further includes an ice container, a second heat exchanger, an air moving apparatus, and an enclosed loop passageway. The ice container is for storing ice produced by the ice maker and includes an exterior surface. The second heat exchanger is for controlling temperature at the ice container. The passageway forms an air flow path such that air travels in thermal contact with the second heat exchanger. The air moving apparatus is positioned to move air through the passageway.

17 Claims, 11 Drawing Sheets

ICE AND WATER SYSTEM IN REFRIGERATOR WITH STIRRING FAN IN ICE CHAMBER

FIELD OF THE INVENTION

The present invention relates generally to ice chambers in fresh food compartments of refrigerators and, more particularly, ice chambers provided with an air moving apparatus to control ice storage temperature.

BACKGROUND OF THE INVENTION

Refrigerators with bottom-mounted freezers offer easy access to the fresh food compartment and provide wide storage space. When an ice and water dispensing system is incorporated on such refrigerators, the dispensing system is provided in the fresh food compartment and an ice chamber portion of the dispensing system can be insulated from the surrounding above-freezing environment. It is also possible to provide cooling to prevent ice from melting or reduce the melting rate and fans have been used to improve circulation of cool air in the ice chamber.

BRIEF SUMMARY OF THE INVENTION

The following presents a simplified summary of the disclosure in order to provide a basic understanding of some example aspects described in the detailed description.

In one example aspect, a refrigerator includes a freezer compartment and a fresh food compartment which includes an ice chamber. The ice chamber includes an ice maker, an ice container, a second heat exchanger, an air moving apparatus, and an enclosed, looped passageway. The ice maker includes a first heat exchanger for producing ice. The ice container is for storing ice produced by the ice maker and includes an exterior surface. The second heat exchanger is for controlling temperature at the ice container. The passageway forms an air flow path such that air travels in thermal contact with the second heat exchanger. The air moving apparatus is positioned to move air through the passageway.

In another example aspect, the passageway is bounded in part by the exterior surface of the ice container.

In yet another example aspect, the vent is configured so that air impinges in a substantially perpendicular manner with respect to the exterior surface.

In yet another example aspect, the passageway is partially defined by an air delivery duct between the second heat exchanger and the exterior surface, and the air delivery duct includes a vent out of which air of the passageway impinges on the exterior surface.

In yet another example aspect, the air delivery duct includes a plurality of vents so as to scatter air over the exterior surface.

In yet another example aspect, the vents are scattered lengthwise about the exterior surface so that air impinging on the exterior surface is scattered lengthwise with respect to the ice container.

In yet another example aspect, the vents are uneven in size and are arranged so that the vents increase in size toward a user side of the refrigerator.

In yet another example aspect, the air delivery duct substantially runs parallel to the exterior surface.

In yet another example aspect, the exterior surface of the ice container is configured with a depressed portion adjacent to the vents.

In yet another example aspect, the passageway is further defined by air flowing beneath the ice container and returning to the second heat exchanger.

In yet another example aspect, the second heat exchanger is located to the rear of the ice container and away from a user side of the refrigerator, and the air moving apparatus is located above the second heat exchanger.

In yet another example aspect, ice is dispensed from the ice chamber through a door on a user side of the refrigerator.

In yet another example aspect, an ice chamber for a fresh food compartment of a refrigerator includes an ice maker including a first heat exchanger, an ice container with an exterior surface, an air moving apparatus, a second heat exchanger, and an enclosed, looped passageway. The air moving apparatus is configured to move air in the passageway and the second heat exchanger is configured to be in thermal contact with air in the passageway.

In yet another example aspect, the passageway is configured so that air of the passageway comes in contact with the exterior surface at least in part of the passageway.

In yet another example aspect, the passageway is configured so that air initially comes in contact with the exterior surface in a substantially perpendicular manner with respect to the exterior surface.

In yet another example aspect, the ice container is substantially box-shaped having side faces and a bottom face, and the exterior surface is one of the side faces.

In yet another example aspect, the order of travel for the air of the passageway is the second heat exchanger, the air moving apparatus, the exterior surface, and the bottom face.

In yet another example aspect, the passageway is configured so that air from the second heat exchanger controls the temperature of the ice container primarily by contacting the one of the side faces and secondarily by contacting the bottom face or another one of the side faces.

In yet another example aspect, the passageway is configured so that air of the passageway contacts the side face at a plurality of portions scattered lengthwise about the one of side faces.

In yet another example aspect, a refrigerator with a refrigerant loop includes a freezer compartment and a fresh food compartment including an ice chamber. The ice chamber includes an ice maker, an ice container, a second heat exchanger, and an air moving apparatus. The ice maker includes a first heat exchanger for producing ice. The first heat exchanger is in refrigerant communication with the refrigerant loop. The ice container is for storing ice produced by the ice maker. The second heat exchanger is for controlling temperature at the ice container and is in refrigerant communication with the refrigerant loop. The air moving apparatus is for blowing air through the second heat exchanger and toward the ice container. The second heat exchanger and the air moving apparatus are configured to maintain below freezing temperature in the ice container.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
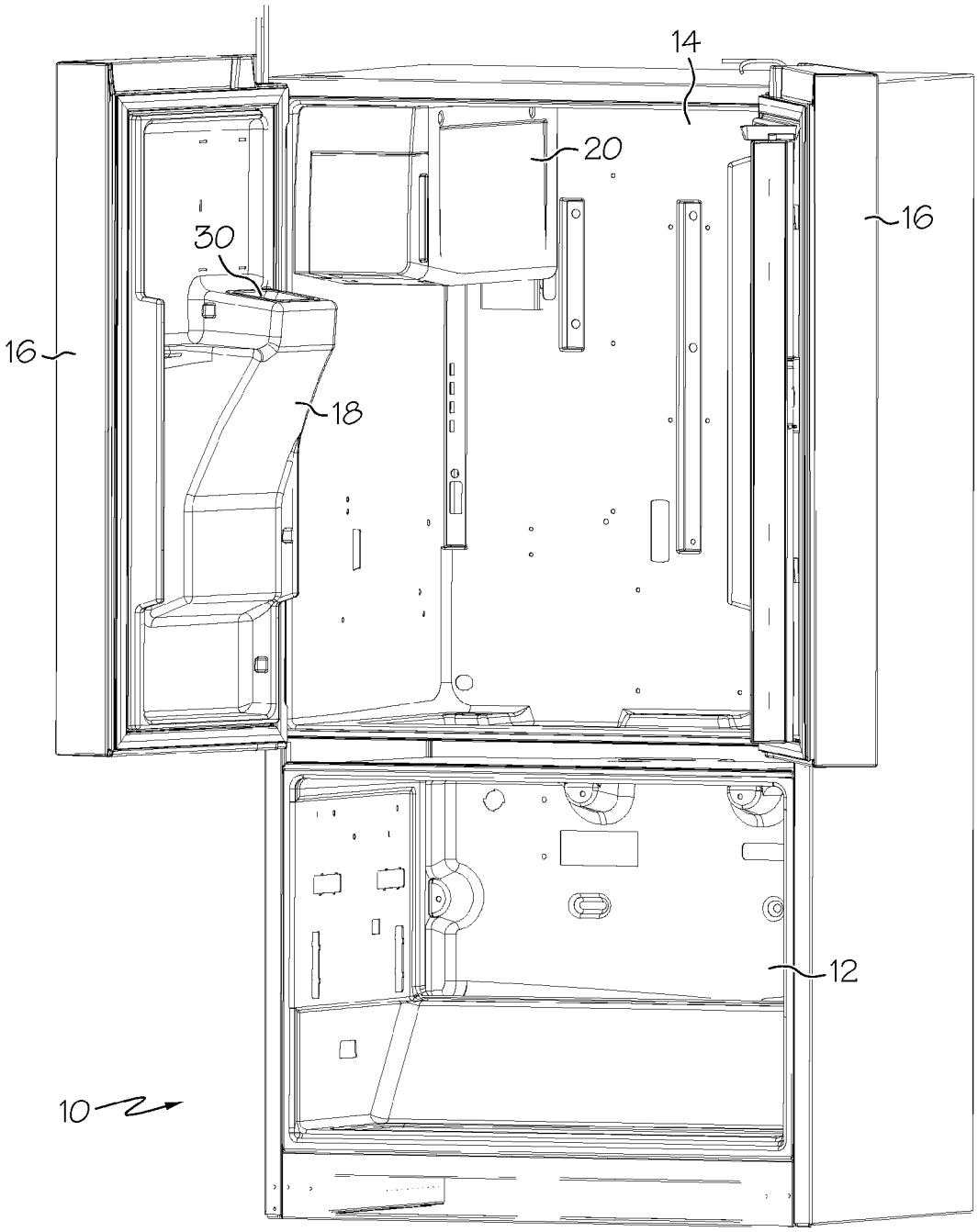
FIG. 1 is an example embodiment of a refrigerator implementing the present invention.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices.

Turning to FIG. 1, an embodiment of a home appliance 10, such as a refrigerator, including a freezer compartment 12 and a fresh food compartment 14 is shown. In this embodiment, the freezer compartment 12 is bottom-mounted but other configurations of the compartments, such as top-mounted freezers and side-by-side refrigerators, are also possible. The top-mounted fresh food compartment 14 has French doors 16 on a user side of the refrigerator 10 and is configured with an ice and water system that dispenses ice and water through one of the doors 16 of the fresh food compartment 14. The ice and water system comprises a dispenser 18, a water supply system (not shown) and an ice chamber 20. The water supply system, which comprises a water tank, a water filter and solenoid valves, supplies water to the dispenser so that water can be provided directly to a user or, alternately, to the ice chamber 20 so that it can be dispensed in the form of ice.

The ice chamber 20 (FIGS. 2A and 2B), located within the fresh food compartment 14, houses an ice maker 22 and provides insulation from the above-freezing environment of the fresh food compartment 14. The ice chamber 20 can be insulated through a variety of ways such as by adhering foams on surfaces of the ice chamber 20 or by constructing the ice chamber 20 of material having insulating characteristics. The ice maker 22 may be located near a top of the ice chamber 20 and may mainly comprise a first heat exchanger 24 (FIG. 3A), an ice mold 26 (FIG. 3B; omitted from FIGS. 2A-2B) and a water filling mechanism (not shown) for filling the ice mold 26 with water. The first heat exchanger 24 is in fluid communication with a refrigerant loop of the refrigerator 10. In this embodiment shown, the first heat exchanger 24 is of a type with fingers 24*a* that respectively reach into slots 26*a* of the ice mold 26 and form partially hollow ice cubes. Alternately, the first heat exchanger 24 may be of a type that is at a distance from the ice mold 26 and does not come in direct contact with the water in the ice mold 26. In such embodiments, the ice chamber 20 may include a first air moving apparatus (not shown) for blowing air by the first heat exchanger 24 toward the ice mold 26. It may be possible for the first air moving apparatus to be configured not only to produce ice but also to preserve the temperature of the produced ice.

Figure 2A:
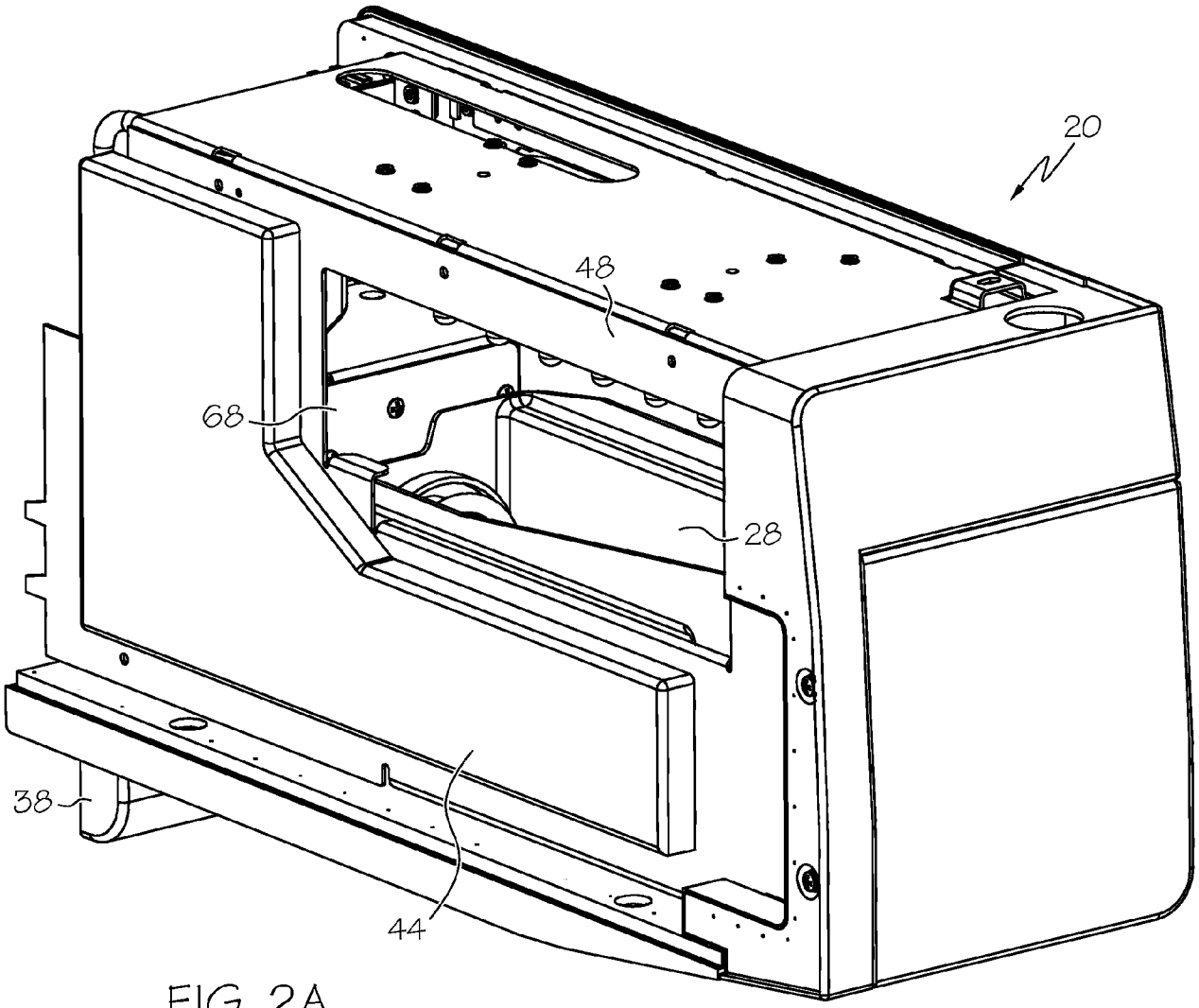
FIG. 2A is a front perspective view of an example embodiment of an ice chamber in an assembled state and implementing the present invention.
Figure 2B:
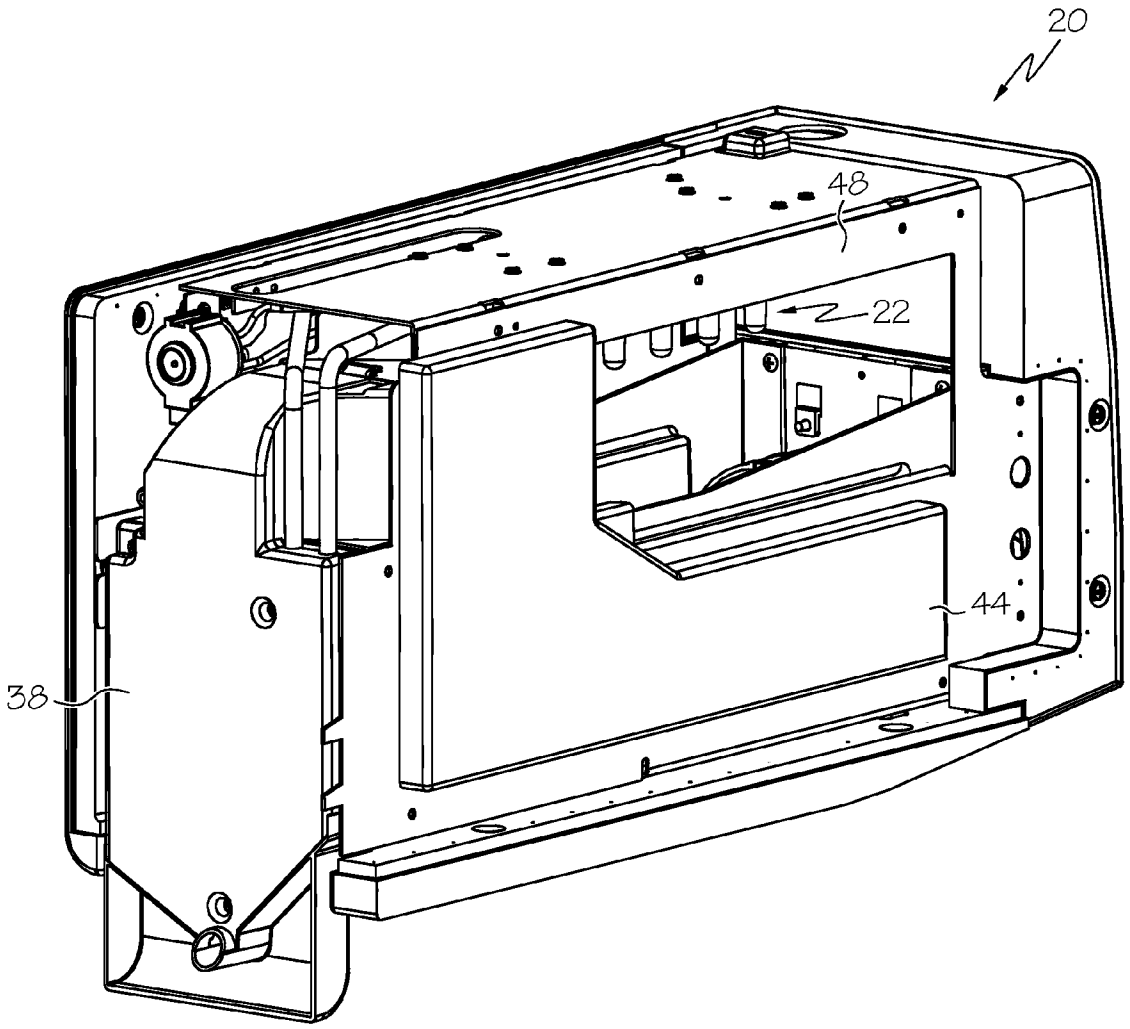
FIG. 2B is a rear perspective view of the ice chamber.
Figure 3A:
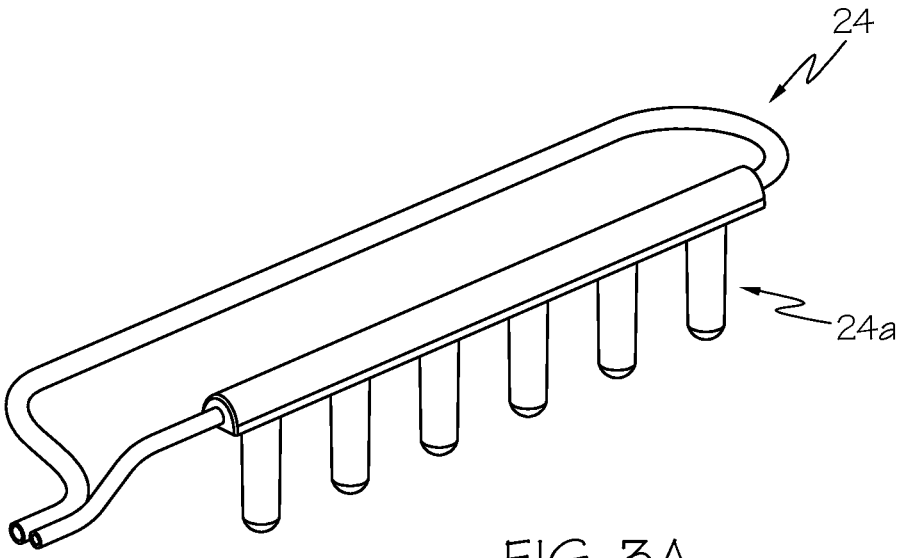
FIG. 3A is an example embodiment of an ice-making heat exchanger.
Figure 3B:
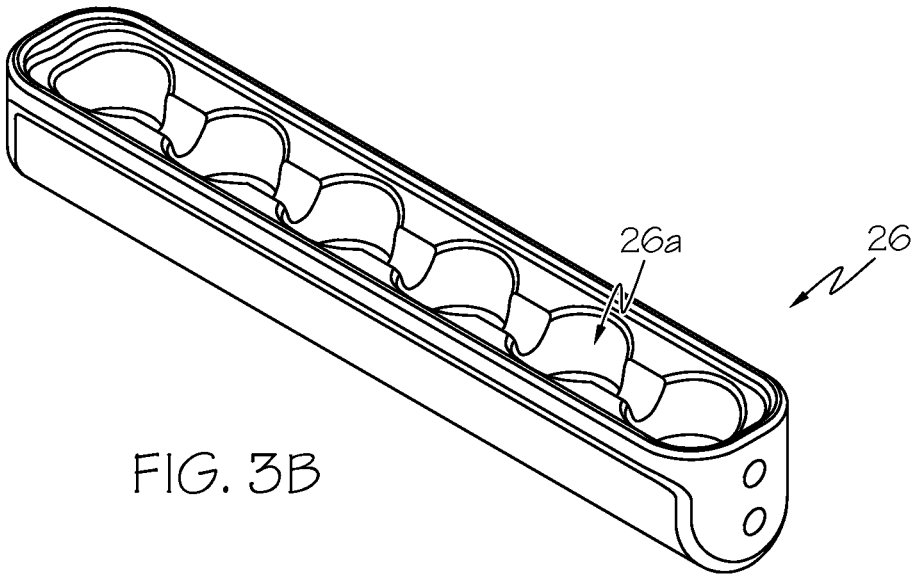
FIG. 3B is an example embodiment of an ice mold.
Figure 4:
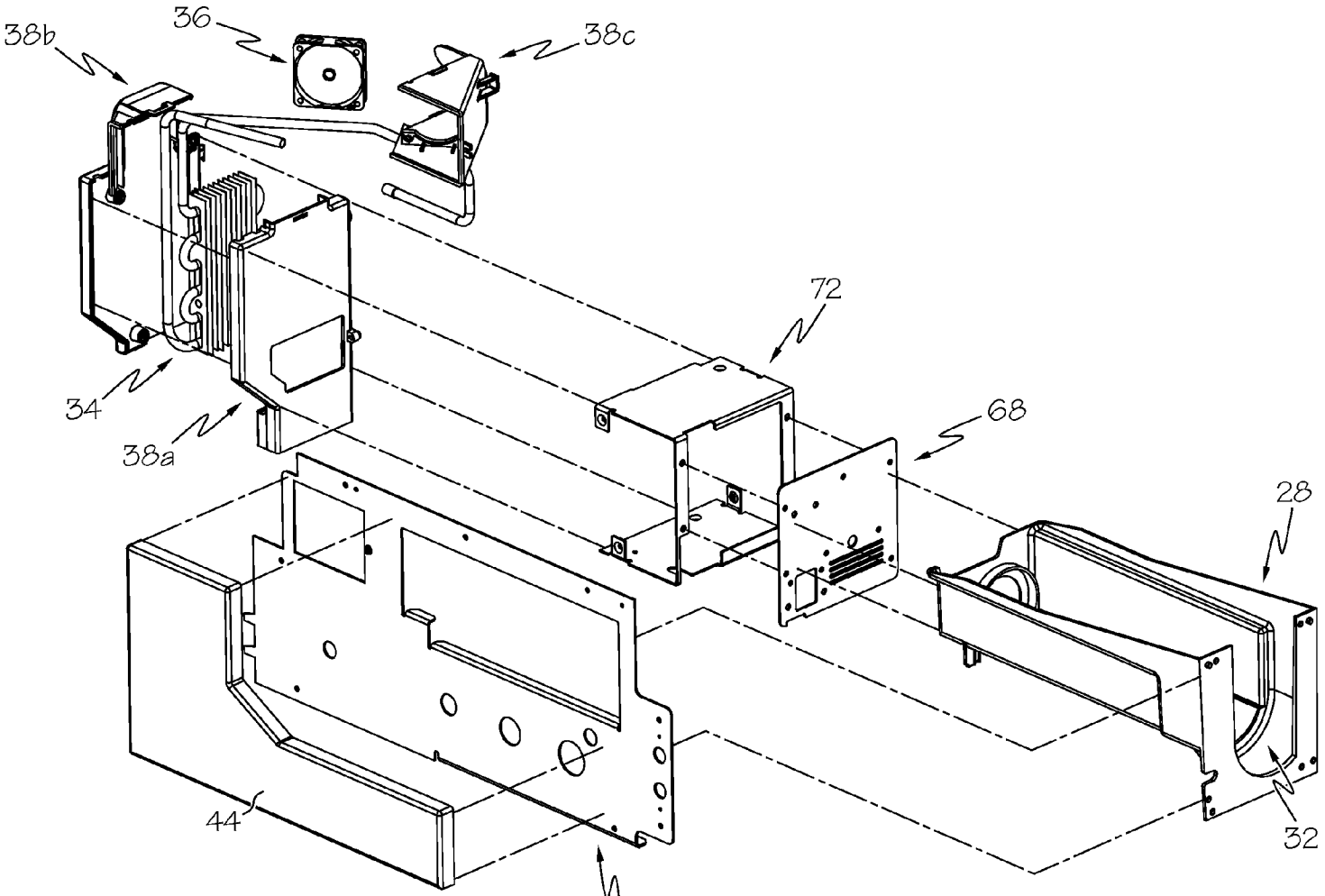
FIG. 4 is a view of the ice chamber in a fragmented state.

As shown in FIG. 2A, the ice chamber 20 also houses an ice container or bin 28 to which ice cubes produced by the ice maker 22 is moved for storage. The ice chamber 20 may also include a mechanism for heating the ice mold 26 to facilitate removal or harvest of the ice cubes from the ice mold 26 and a mechanism for removing the ice cubes from the ice container 28 such as by rotating the ice mold 26 so that the ice cubes are dropped into the ice container 28. The ice container 28 may also be configured with an auger (not shown) to generate movement of ice cubes out of the ice container 28 and to the dispenser 18. As shown in FIG. 4, the ice container 28 includes an opening 32 that is located at the front of the ice chamber 20 and leads to a chute 30 (FIG. 1) which communicates with the dispenser 18 on one of the French doors 16. A user may request ice such as by pressing a cup against a lever that activates operation of the auger or by pushing a button on a user control panel. Moreover, the ice maker 22 may be configured so as to detect the amount of ice in the ice container 28 and to automatically refill the ice container 28 to a predetermined level.

Aspects relating to the present invention are illustrated in detail in FIG. 4 which shows the ice chamber 20 in a fragmented state. A second heat exchanger 34 and a second air moving apparatus 36 may be provided to control the temperature of ice stored in the ice container 28. The second heat exchanger 34 and the second air moving apparatus 36 may be located inside or adjacent to the ice chamber 20. The second heat exchanger 34 may be part of a refrigerant loop of the refrigerator 10 as may be the first heat exchanger 24, unlike the first heat exchanger 24, is primarily provided for the purpose of controlling the temperature of ice storage while the first heat exchanger 24 is primarily provided for the purpose of making ice. The refrigerator 10 also includes an additional unit heat exchanger that is provided to control the temperature of the freezer compartment 12. The second air moving apparatus 36 is an axial fan in this embodiment but may include any other means of generating air flow.

Figure 5:
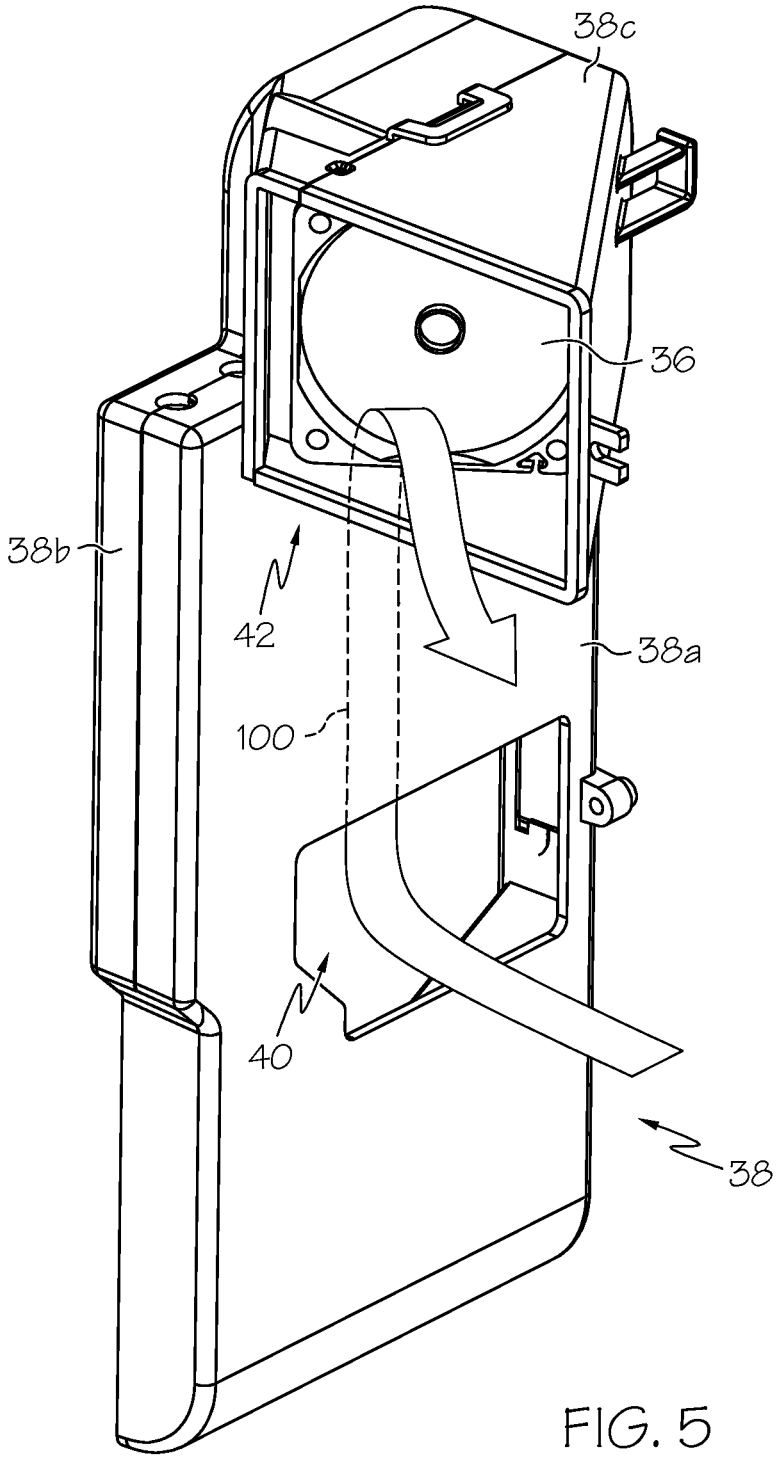
FIG. 5 is a view of a rear duct structure with air flow according to the present invention indicated by arrow.

As shown in FIG. 4, the second heat exchanger 34 and the second air moving apparatus 36 may be provided at the rear of the ice chamber 20. As shown in FIG. 5, the second heat exchanger 34 and the second air moving apparatus 36 may be enclosed within a rear duct structure 38 comprising duct elements 38*a*, 38*b*, 38*c* that define a first passageway 100 indicated by an arrow. The duct element 38*c* houses the second air moving apparatus 36 while the duct elements 38*a*, 38*b* substantially enclose the second heat exchanger 34. The duct element 38*a* includes a first opening 40 through which air enters the passageway 100 and the duct element 38*c* includes a second opening 42 through which air exits the passageway 100. The passageway 100 encompasses the second heat exchanger 34 and the second air moving apparatus 36 in that air must go through the second heat exchanger 34 and the second air moving apparatus 36 as it flows between duct elements 38*a* and 38*b*.

Figure 6:
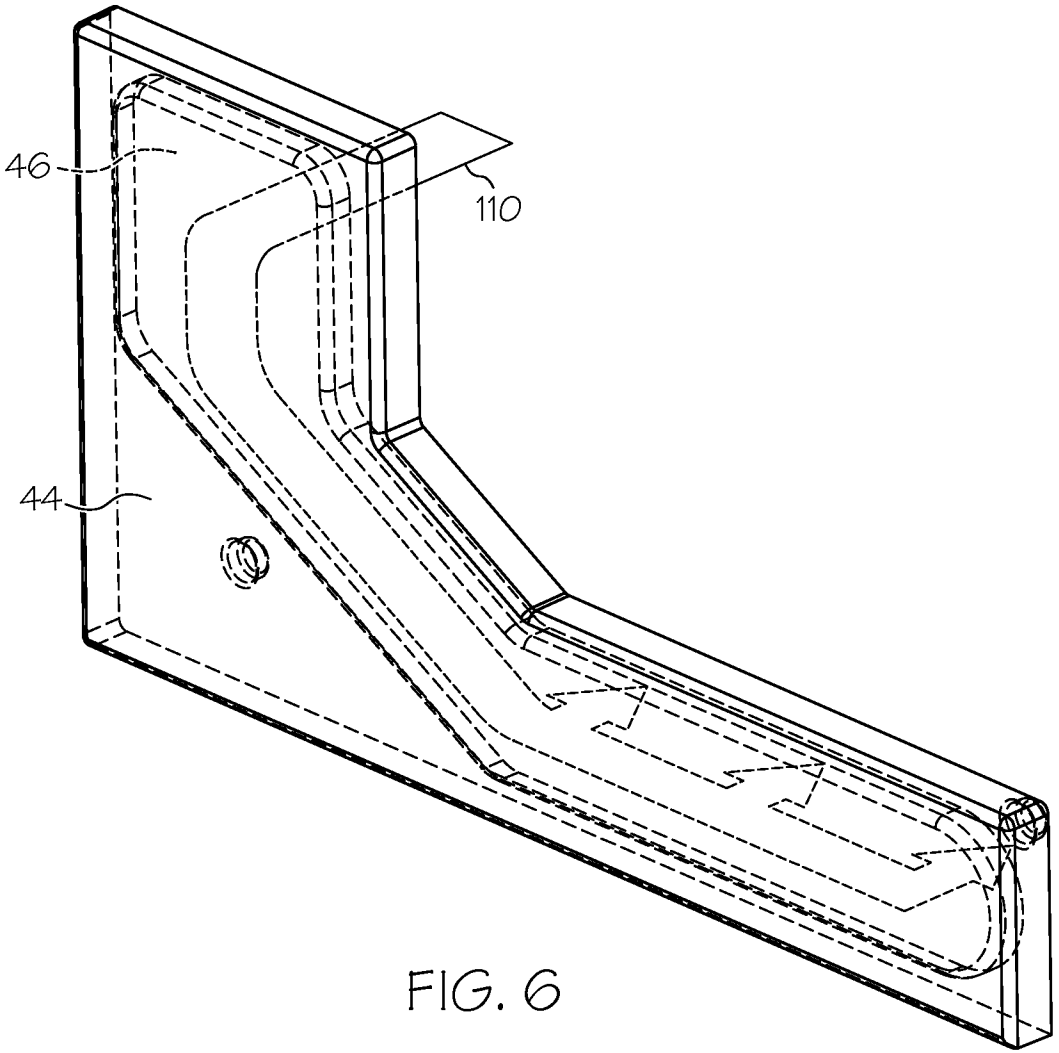
FIG. 6 is a view of an air delivery housing with air flow according to the present invention indicated by arrow.
Figure 7:
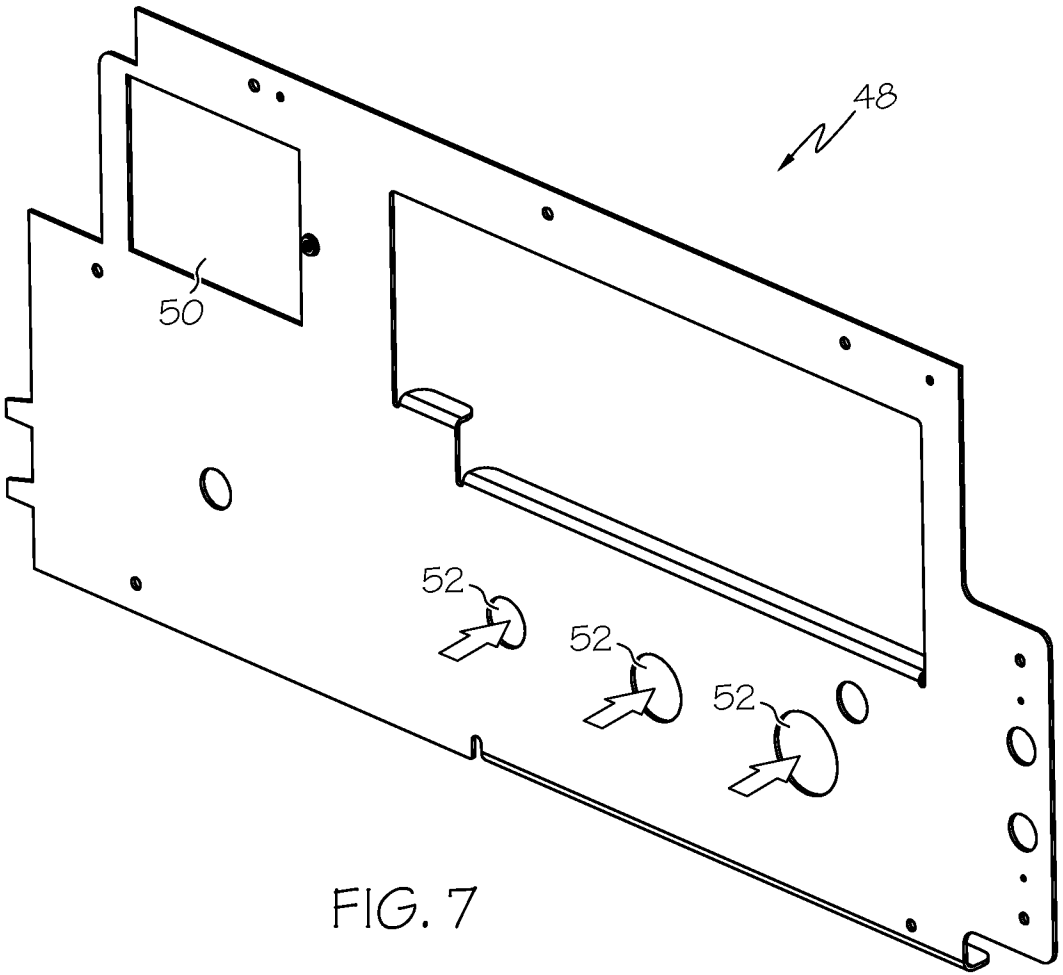
FIG. 7 is a view of an air channeling plate with air flow according to the present invention indicated by arrows.

Cold air from the second heat exchanger 34 in the passageway 100 goes through an entry 50 of an air channeling plate 48 (FIG. 7) and enters an air delivery housing 44 which is in air communication with the duct element 38*c*. In this embodiment, the air delivery housing 44 is a substantially flat structure that is located laterally within the ice chamber 20 so as to span part of a side face of the ice chamber 20. The air delivery housing 44 includes a depressed portion 46 (FIG. 6) for channeling air through the air delivery housing 44. The air channeling plate 48 abuts the air delivery housing 44 and encloses the depressed portion 46 except at the entry 50 and at vents 52 thereby forming an air delivery duct and defining a second passageway 110 indicated by arrows. In the second passageway 110, air from the duct element 38*c* goes through the entry 50, travels the depressed portion 46 and exits the air delivery housing 44 at the vents 52. The air channeling plate 48 is placed in the ice chamber 20 so that the vents 52 are located adjacent an exterior surface 54 of the ice container 28. In this embodiment, the air channeling plate 48 is substantially parallel to the exterior surface 54 so that air out of the vents 52 impinges in a substantially perpendicular manner with respect to the exterior surface 54 of the ice container 28. This embodiment of the air delivery housing 44 has three vents 52 that are circular and increase in size toward the dispenser 18 of the refrigerator 10. Therefore, more air is likely to impinge against the ice container 28 at the front than the rear of the ice container 28 as indicated by arrows of various sizes. The vents 52 may vary in number, shape, size and arrangement and accomplish varying effects of air flow. For example, a plurality of vents 52 across the air channeling plate 48 means that more air can be scattered across the exterior surface 54. Also, if the vents 52 are scattered lengthwise about the exterior surface 54, air impinging against the ice container 28 can be spread more evenly across the exterior surface 54.

Figure 8:
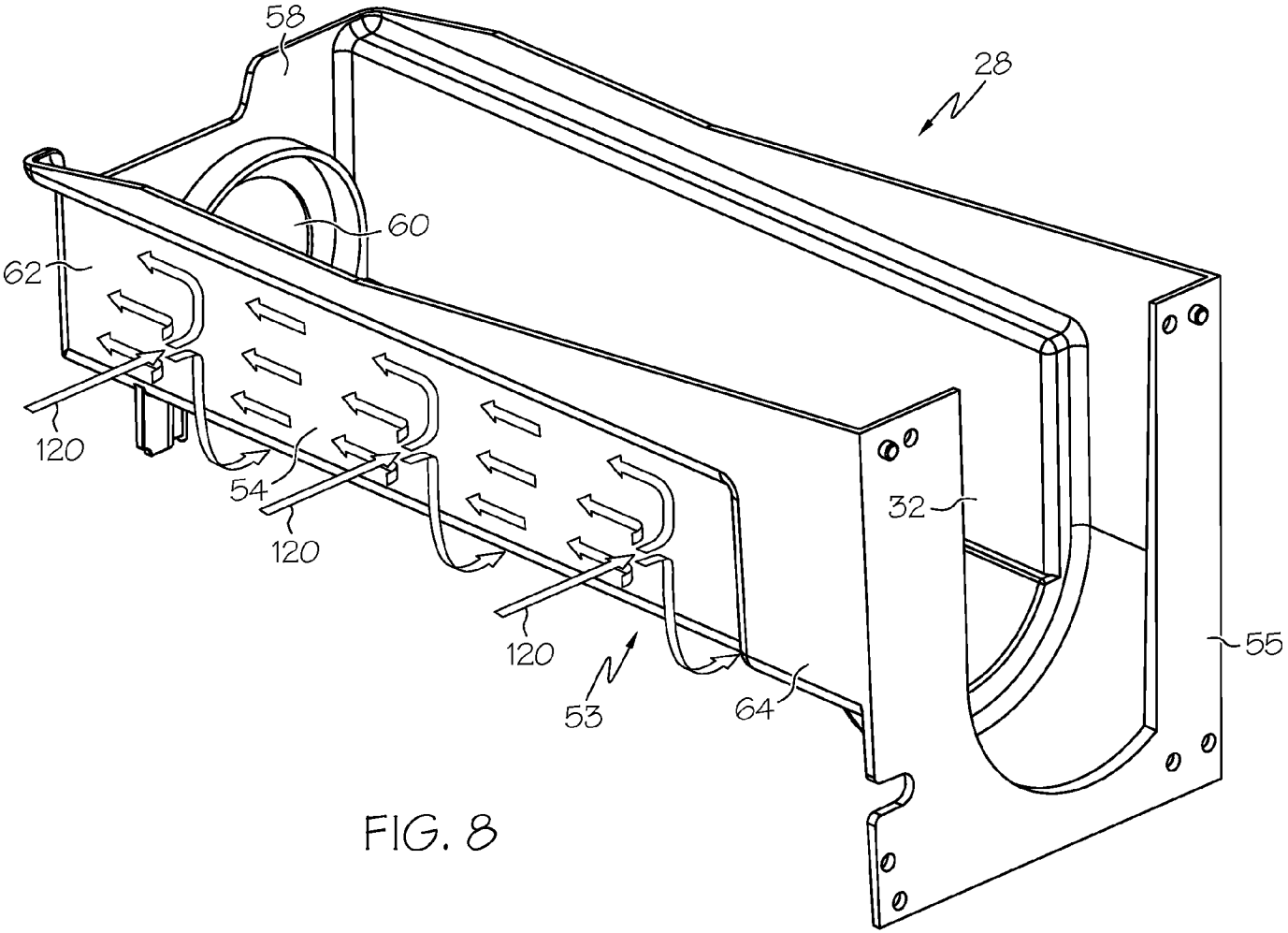
FIG. 8 is a view of one side of an ice container with air flow according to the present invention indicated by arrows.
Figure 9:
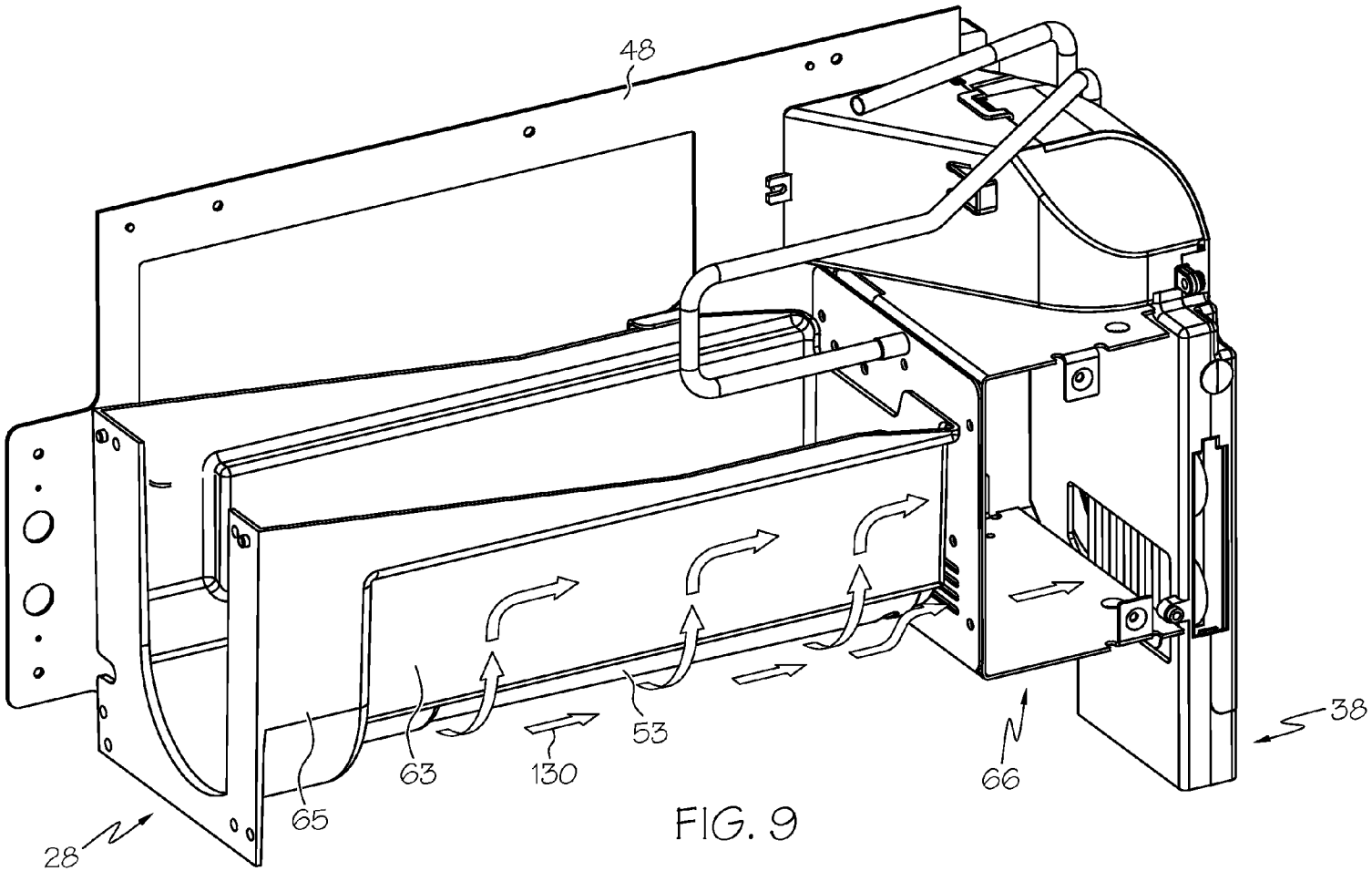
FIG. 9 is a view of another side of ice container and a motor room with air flow according to the present invention indicated by arrows.
Figure 10:
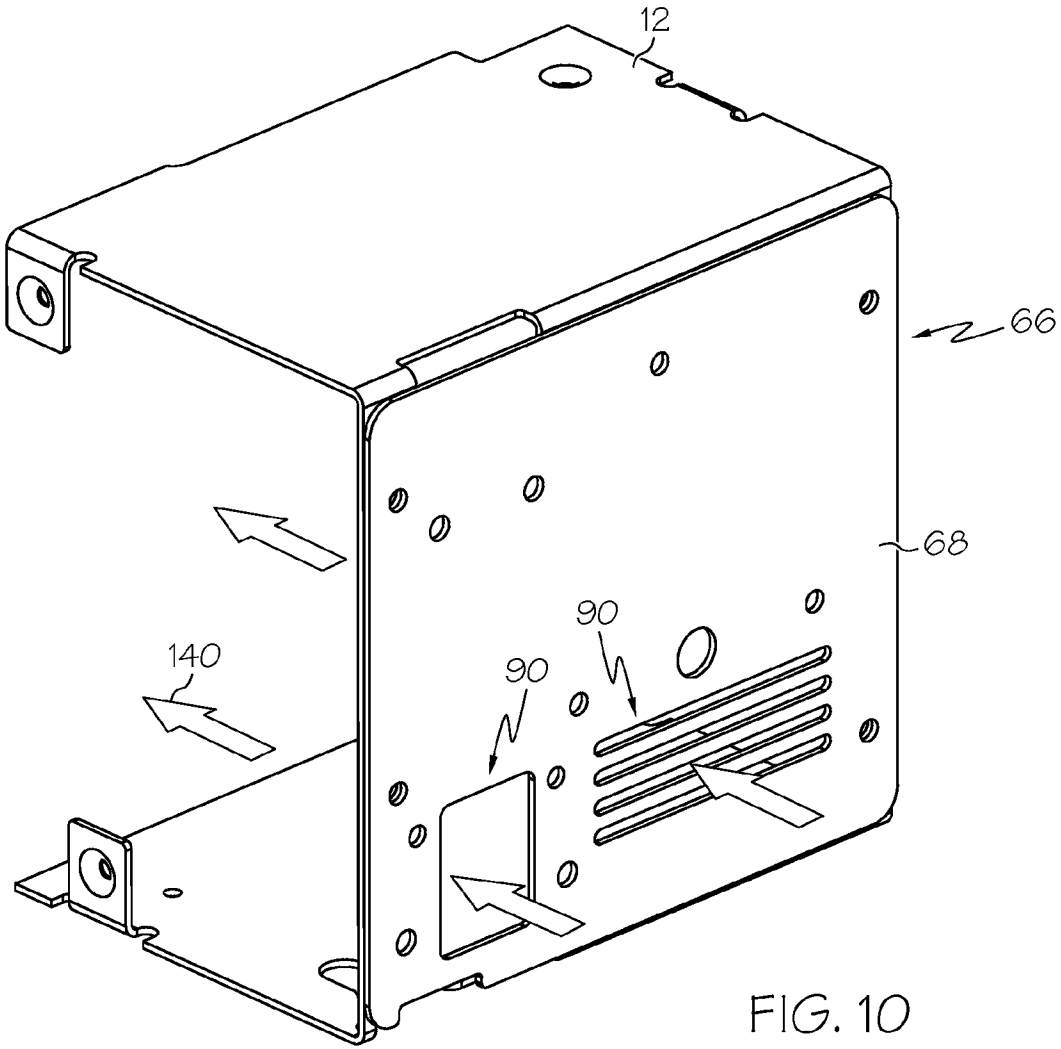
FIG. 10 is a view of the motor room with air flow according to the present invention indicated by arrows.

The ice container 28 may have a variety of shapes and, in this embodiment (FIG. 8), is a box-shaped element with a half-pipe-like bottom face 53, four surrounding side faces, and an open top. A front face 55 is configured with an opening 32 leading to the chute 30 while a rear face 58 includes a hole 60 through which the auger extends into the interior of the ice container 28. Air exiting through the vents 52 strikes or impinges against a depressed portion 62 of the ice container 28. Although the air may be scattered across the depressed portion 62 and in various directions, such as toward the front face 55, the bottom face 53 or even a second lateral face 65 (FIG. 9) of the ice container 28, it is difficult for the air to escape the depressed portion 62 and the air is eventually channeled toward the rear of the ice container 28 thereby defining a third passageway 120 which is indicated by arrows. As shown in FIG. 9, the ice container 28 can be located in an elevated manner relative to a bottom of the ice chamber 20 so that there is a space between the bottom of the ice chamber 20 and a bottom of the ice container 28. Thus, it is possible for the air from the depressed portion 62 to flow toward the bottom face 53 and eventually reach a depressed portion 63 on the second lateral face 65 of the ice container 28 thereby defining a fourth passageway 130 which is indicated by arrows. The half-pipe shape of the bottom face 53 contributes to such air flow. The air thereafter flows into a motor room 66. It must be noted that the exterior surface 54 against which air from the air delivery housing 44 impinges is not to be limited to the depressed portion 62. The exterior surface 54 against which cold air impinges may also be the first lateral face 64, the second lateral side face 65, the bottom face 53, the rear face 58, or the front face 55 depending on the configuration of the ice chamber 20. Based on the above, the exterior surface 54 can be viewed as defining or acting as a boundary to the third passageway 120 or fourth passageway 130 since it determines a path of the air. Moreover, the impingement or thermal contact of the cold air on the exterior surface 54 is intended to create a heat exchange or a conduction of heat from the inside of the ice container 28 to the outside.

Located at the rear of the ice chamber 20, the motor room 66 may house an auger motor, a solenoid, a solenoid actuator and a guide clip. The motor room 66 is substantially formed by a frame 72 and partly bounded by a first wall 68 which includes a first opening 70 allowing air from around the ice container 28 to enter the motor room 66. The motor room 66 is further bounded by the duct element 38*a* which is located opposite the first wall 68. Thus, air that has entered the motor room 66 exits through the first opening 40 thereby defining a fifth passageway 140 which is indicated by arrows and repeats the looped circulation within the ice chamber 20 via the passageways 100, 110, 120, 130 and 140 which are in air communication.

A possible benefit of the present invention is that the second heat exchanger 34 and the second air moving apparatus 36 are provided in the ice chamber 20 to improve and maintain the storage temperature of ice which is affected by the above-freezing temperature of the fresh food compartment 14. Moreover, the passageways 100, 110, 120, 130 and 140 provide simple air movement in the ice chamber 20 resulting in improved temperature conditions for the ice. Thus, ducting of cold air from the freezer or unit heat exchanger to the ice chamber 20 is not necessary and loss of refrigeration efficiency arising from such ducting is avoided. Furthermore, improved temperature conditions can also be expected from the various configurations of impingement of air flow with respect to the ice container 20.

The heat exchangers 24, 34 are evaporators in this embodiment but it is noted that heat exchange can occur through other means such as thermoelectric devices.

The arrows are provided mainly to indicate the passageways which form a loop of air flow within the ice chamber and must not be interpreted to exclude possible air flow in directions that are not indicated by the arrows. The ice and water system may further be configured with additional components such as an ice level detector for detecting the amount of ice in the ice container. It must be noted that the ice and water system may include other components all of which are coordinated to accomplish systematic provision of ice and water. The lack of description of other components should not be interpreted to mean that they are absent or incompatible with the present invention. A person of ordinary skill in the art can adapt the ice and water system discussed here to make it compatible with what is already known in the art and future developments.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A refrigerator including:

a freezer compartment; and a fresh food compartment located vertically above the freezer compartment and including an ice chamber exposed to an above-freezing environment within the fresh food compartment, the ice chamber providing insulation from the above-freezing environment of the fresh food compartment and including:

an ice maker disposed within the ice chamber and configured to receive water and including a first evaporator disposed within the ice chamber and in fluid communication with a refrigerant loop and configured to freeze said water to produce ice;

an ice container disposed within the ice chamber and configured to store ice produced by the ice maker within the ice chamber, the ice container including a first lateral side exterior surface extending along a longitudinal axis of the ice container, a second evaporator disposed within the ice chamber, located at a rear of the ice chamber and away from a user side of the refrigerator, and in fluid communication with the refrigerant loop and configured to control temperature at the ice container to maintain a below freezing temperature in the ice container;

an air moving apparatus disposed within the ice chamber and located adjacent the second evaporator; and an enclosed, looped passageway forming an air flow path contained within the ice chamber such that air travels in thermal contact with the second evaporator to be cooled, wherein the air moving apparatus is positioned to move air through the passageway, wherein the passageway is bounded in part by the first lateral side exterior surface of the ice container, and wherein the passageway is partially defined by an air delivery duct extending between the second evaporator and the first lateral side exterior surface of the ice container, and the air delivery duct is located on one side of the ice maker and is defined between an outer plenum panel and a second lateral side panel of the ice chamber that defines an interior boundary of the ice chamber and the air delivery duct is in communication with a vent comprising a plurality of vents formed in the second lateral side panel that extend along the longitudinal length of the ice container and through which said cooled air from the second evaporator and provided by the air moving apparatus is exhausted in a direction perpendicular to the plurality of vents into said region adjacent to said ice container, and wherein the second lateral side panel of the ice chamber includes a first depressed portion, wherein the air delivery duct is substantially parallel to the first lateral side exterior surface of the ice container so that air out of the second lateral side panel impinges in a substantially perpendicular manner with respect to the first lateral side exterior surface of the ice container.

2. The refrigerator of claim 1, wherein the vent is configured so that air impinges in a substantially perpendicular manner with respect to the first lateral side exterior surface.

3. The refrigerator of claim 1, wherein the plurality of vents scatter air substantially evenly over the lateral side exterior surface of the ice container.

4. The refrigerator of claim 3, wherein the vents are scattered lengthwise about the lateral side exterior surface of the ice container so that air impinging on the lateral side exterior surface is scattered lengthwise with respect to the ice container.

5. The refrigerator of claim 3, wherein the vents are uneven in size and are arranged so that the vents increase in size toward a user side of the refrigerator.

6. The refrigerator of claim 3, wherein the first lateral side exterior surface of the ice container is configured with a second depressed portion extending along said longitudinal axis of the ice container adjacent to the vents and terminating at said rear of the ice chamber.

7. The refrigerator of claim 6, wherein the second depressed portion extends to a bottom of the ice container, and the passageway is further defined by air flowing in the second depressed portion beneath the ice container and returning to the second evaporator at said rear of the ice chamber.

8. The refrigerator of claim 7, wherein the air moving apparatus is located above the second evaporator.

9. The refrigerator of claim 1, wherein ice is dispensed from the ice chamber through a door on a user side of the refrigerator.

10. An ice chamber disposed within a fresh food compartment of a refrigerator and exposed to an above-freezing environment within the fresh food compartment and providing insulation from the above-freezing environment of the fresh food compartment, including:

an ice maker disposed within the ice chamber and configured to receive water and including a first evaporator disposed within the ice chamber and in fluid communication with a refrigerant loop and configured to freeze said water to produce ice;

an ice container disposed within the ice chamber and with a first lateral side exterior surface extending along a longitudinal axis of the ice container, the ice container further including an opening that is located at a front of the ice chamber;

an air moving apparatus disposed within the ice chamber; a second evaporator disposed within the ice chamber adjacent the air moving apparatus, located at a rear of the ice chamber and away from said front of the ice chamber, and in fluid communication with the refrigerant loop and configured to actively control temperature at the ice container to maintain a below freezing temperature in the ice container;

a rear duct structure disposed within the ice chamber and located at said rear of the ice chamber that houses the air moving apparatus and substantially encloses the second evaporator, and comprising a first opening towards a bottom of the rear duct structure through which air enters and a second opening towards a top of the rear duct structure through which air is exhausted; and an enclosed, looped passageway contained within the ice chamber that extends through the rear duct structure from the first opening towards the second opening, the air moving apparatus configured to move air in the passageway into the first opening, and along the second evaporator and subsequently exhausted out of the second opening towards the ice container, such that the second evaporator is configured to be in thermal contact with air in the passageway to thereby cool said air, and an air delivery duct is located on one side of the ice maker and is defined between an outer plenum panel and a second lateral side panel of the ice chamber that defines an interior boundary of the ice chamber and the air delivery duct is in communication with a vent comprising a plurality of vents formed in the second lateral side panel that extend along the longitudinal length of the ice container and through which said cooled air from the second evaporator and provided by the air moving apparatus is exhausted in a direction perpendicular to the plurality of vents into said region adjacent to said ice container, and wherein the second lateral side panel of the ice chamber includes a first depressed portion, wherein the air delivery duct is substantially parallel to the first lateral side exterior surface of the ice container so that air out of the second lateral side panel impinges in a substantially perpendicular manner with respect to the first lateral side exterior surface of the ice container.

11. The ice chamber of claim 10, wherein the passageway is configured so that air of the passageway comes in contact with the lateral side exterior surface of the ice container at least in part of the passageway.

12. The ice chamber of claim 11, wherein the passageway is configured so that air initially comes in contact with the lateral side exterior surface of the ice container in a substantially perpendicular manner with respect to the lateral side exterior surface.

13. The ice chamber of claim 11, wherein the ice container is substantially box-shaped having side faces and a bottom face, and the lateral side exterior surface is one of the side faces.

14. The ice chamber of claim 13, wherein an order of travel for the air of the passageway is the second evaporator, the air moving apparatus, the lateral side exterior surface, and the bottom face.

15. The ice chamber of claim 13, wherein the passageway is configured so that air from the second evaporator controls a temperature of the ice container by contacting the one of the side faces and by contacting the bottom face or another one of the side faces.

16. The insulated ice chamber of claim 15, wherein the passageway is configured so that air of the passageway contacts the side face at a plurality of portions scattered lengthwise about the one of side faces.

17. A refrigerator with a refrigerant loop including:

a freezer compartment comprising a unit heat exchanger that is provided to control the temperature of the freezer compartment; and a fresh food compartment located vertically above the freezer compartment and including an ice chamber exposed to an above-freezing environment within the fresh food compartment, the ice chamber providing insulation from the above-freezing environment of the fresh food compartment and including:

an ice maker disposed within the ice chamber and including a first evaporator disposed within the ice chamber and configured to freezer water to produce ice, the first evaporator being in refrigerant communication with the refrigerant loop;

an ice container disposed within the ice chamber for storing ice produced by the ice maker within the ice chamber, the ice container including a first lateral side exterior surface;

a second evaporator disposed within the ice chamber, located at a rear of the ice chamber and away from a user side of the refrigerator for controlling temperature at the ice container to maintain a below freezing temperature in the ice container, the second evaporator being in refrigerant communication with the refrigerant loop; and an air moving apparatus disposed within the ice chamber and located above the second evaporator for blowing air through the second heat exchanger and toward the ice container, wherein the second evaporator and the air moving apparatus are enclosed within a rear duct structure disposed within the ice chamber and located at said rear of the ice chamber, and are configured to maintain below freezing temperature in the ice container without using air cooled by the unit heat exchanger of the freezer compartment, and an air delivery duct is located on one side of the ice maker and is defined between an outer plenum panel and a second lateral side panel of the ice chamber that defines an interior boundary of the ice chamber and the air delivery duct is in communication with a vent comprising a plurality of vents formed in the second lateral side panel that extend along the longitudinal length of the ice container and through which said cooled air from the second evaporator and provided by the air moving apparatus is exhausted in a direction perpendicular to the plurality of vents into said region adjacent to said ice container, and wherein the second lateral side panel of the ice chamber includes a first depressed portion, wherein the air delivery duct is substantially parallel to the first lateral side exterior surface of the ice container so that air out of the second lateral side panel impinges in a substantially perpendicular manner with respect to the first lateral side exterior surface of the ice container.

* * * * *